US008293379B2

(12) United States Patent
Kim et al.

(10) Patent No.: US 8,293,379 B2
(45) Date of Patent: Oct. 23, 2012

(54) QUENCHABLE STEEL SHEET HAVING HIGH HOT PRESS WORKABILITY AND METHOD OF MANUFACTURING THE SAME

(75) Inventors: Taekjoon Kim, Seosan-si (KR); Seungha Lee, Chungcheongnam-do (KR); Seongju Kim, Yongin-si (KR)

(73) Assignee: Hyundai Steel Company, Incheon (KR)

( * ) Notice: Subject to any disclaimer, the term of this patent is extended or adjusted under 35 U.S.C. 154(b) by 0 days.

(21) Appl. No.: 13/029,634

(22) Filed: Feb. 17, 2011

(65) Prior Publication Data

US 2011/0159314 A1 Jun. 30, 2011

Related U.S. Application Data

(63) Continuation of application No. PCT/KR2009/007996, filed on Dec. 30, 2009.

(51) Int. Cl.

| | |
|---|---|
| ***B32B 15/20*** | (2006.01) |
| ***B32B 15/18*** | (2006.01) |
| ***C22C 38/02*** | (2006.01) |
| ***C22C 38/04*** | (2006.01) |
| ***C22C 38/10*** | (2006.01) |
| ***C22C 38/14*** | (2006.01) |
| ***C22C 38/16*** | (2006.01) |
| ***C22C 38/60*** | (2006.01) |

(52) U.S. Cl. ..... 428/653; 420/84; 420/89; 420/93; 420/121; 420/125

(58) Field of Classification Search ..... None
See application file for complete search history.

(56) References Cited

U.S. PATENT DOCUMENTS 6,221,179 B1 * 4/2001 Yasuhara et al. ..... 148/320

FOREIGN PATENT DOCUMENTS

| | | | |
|---|---|---|---|
| EP | 1013785 | A1 * | 6/2000 |
| JP | 2001-348647 | A | 12/2001 |
| JP | 2006-037130 | A | 2/2006 |
| JP | 2007-284776 | A | 11/2007 |

OTHER PUBLICATIONS

JP 2001-348647 (JPO Machine Translation).*
JP2007-284776 (JPO Machine Translation).*
ASM Specialty Handbook: Aluminum and Aluminum Alloys, pp. 41, 46, ed. J.R. Davis, ASM International, Materials Park OH 44073.*
International Search Report dated Sep. 27, 2010 in International Application No. PCT/KR2009/007996 (3 pages).

* cited by examiner

*Primary Examiner* — John J Zimmerman
(74) *Attorney, Agent, or Firm* — Knobbe Martens Olson & Bear, LLP

(57) ABSTRACT

The quenchable steel sheet has an alloy composition including carbon (C) in an amount of 0.15~0.30 wt %, silicon (Si) in an amount of 0.05~0.5 wt %, manganese (Mn) in an amount of 1.0~2.0 wt %, boron (B) in an amount of 0.0005~0.0040 wt %, sulfur (S) in an amount of 0.003 wt % or less, phosphorus (P) in an amount of 0.012 wt % or less, one or more selected from among calcium (Ca) in an amount of 0.0010~0.0040 wt % and copper (Cu) in an amount of 0.05~1.0 wt %, two or more selected from among cobalt (Co), zirconium (Zr) and antimony (Sb), and iron (Fe). Alloy elements are controlled to increasing hot ductility and enabling pressing at 600~900° C. so that a tensile strength of 1400 MPa or more and an elongation of 8% or more are obtained after pressing.

8 Claims, 4 Drawing Sheets

(a) COMPARATIVE EXAMPLE 1

(b) INVENTIVE EXAMPLE 1

(a) COMPARATIVE EXAMPLE 1

(b) INVENTIVE EXAMPLE 1

QUENCHABLE STEEL SHEET HAVING HIGH HOT PRESS WORKABILITY AND METHOD OF MANUFACTURING THE SAME

RELATED APPLICATIONS

This application is a continuation application under 35 U.S.C. §365(c) of International Application No. PCT/KR2009/007996, filed Dec. 30, 2009 designating the United States. This application incorporates herein by reference the International Application No. PCT/KR2009/007996 in their entirety.

TECHNICAL FIELD

The present disclosure relates to a quenchable steel sheet having high hot press workability and a method of manufacturing the same.

BACKGROUND ART

In the current state of the automobile industry, the application of ultrahigh strength steel sheets is increasing in order to cope with the requirements of safety and lightness. However, it is difficult to use ultrahigh strength steel sheets to produce automobile parts having complicated shapes because they have low formability. Thus the demand for quenchable steel sheets ensuring high strength by heating, hot pressing and then quenching them.

This section is to provide general background information, and does not constitute an admission of prior art.

SUMMARY

An aspect of the present invention is to provide a quenchable steel sheet having high hot press workability and enhanced hot ductility so as to facilitate hot pressing, and a method of manufacturing the same.

Another aspect of the present invention is to provide a quenchable steel sheet and a method of manufacturing the same, the quenchable steel sheet having high hot press workability so that the quenchable steel sheet can be pressed even at a low temperature, such as 600° C., thereby minimizing the generation of oxide scales when the steel sheet is a non-plated steel sheet and preventing the surface of the sheet from being damaged when the sheet is a plated steel sheet.

In an aspect of the invention, a quenchable steel sheet having an alloy composition comprises carbon (C) in an amount of 0.15~0.30 wt %, silicon (Si) in an amount of 0.05~0.5 wt %, manganese (Mn) in an amount of 1.0~2.0 wt %, boron (B) in an amount of 0.0005~0.0040 wt %, sulfur (S) in an amount of 0.003 wt % or less, phosphorus (P) in an amount of 0.012 wt % or less, one or more selected from among calcium (Ca) in an amount of 0.0010~0.0040 wt % and copper (Cu) in an amount of 0.05~1.0 wt %, two or more selected from among cobalt (Co); zirconium (Zr) and antimony (Sb), and iron (Fe) and other inevitable impurities.

The method of manufacturing a quenchable steel sheet, comprises hot pressing a plated steel sheet at 600~900° C., thus exhibiting a tensile strength of 1400 MPa or more and an elongation of 8% or more, wherein the plated steel sheet having an alloy composition comprising carbon (C) in an amount of 0.15~0.30 wt %, silicon (Si) in an amount of 0.05~0.5 wt %, manganese (Mn) in an amount of 1.0~2.0 wt %, boron (B) in an amount of 0.0005~0.0040 wt %, sulfur (S) in an amount of 0.003 wt % or less, phosphorus (P) in an amount of 0.012 wt % or less, one or more selected from among calcium (Ca) in an amount of 0.0010~0.0040 wt % and copper (Cu) in an amount of 0.05~1.0 wt %, two or more selected from among cobalt (Co), zirconium (Zr) and antimony (Sb), andiron (Fe) and other inevitable impurities.

The zirconium (Zr) may be contained in an amount of 0.0005~0.1 wt %.

The cobalt (Co) and antimony (Sb) are present in amounts satisfying 0.0005 wt %≦(Co+Sb)≦0.5 wt %.

The weight ratio of Ca/S may fall in the range of 0.5~3.0.

The hot pressing process may be performed by heating the plated steel sheet to 700° C. or higher, placing the heated steel sheet into a die, and performing pressing at 600~900° C. and cooling in the die.

The plated steel sheet may be an Al—Si plated steel sheet.

According to embodiments of the present invention, to ensure hot ductility at least two selected from among cobalt (Co), antimony (Sb) and zirconium (Zr) are used, instead of titanium (Ti), niobium (Nb), molybdenum (Mo) or chromium (Cr) that causes cracks on a steel sheet during hot pressing. Because pressing is possible at a low temperature, the energy consumption can be reduced, and in the case of a plated steel sheet, a plating layer can be protected, and in the case of a non-plated steel sheet, the occurrence of oxide scales can be prevented.

Even when the plating layer is formed to have a thickness of 10 μm to 30 μm, scales are not formed, and the generation of cracks and pores on the plating layer can be reduced; thus corrosion resistance increases.

Also according to embodiments of the present invention, in lieu of aluminum, silicon which is inexpensive is used as a deoxidizer during steel making; thus economic benefits are maximized.

Also, according to embodiments of the present invention, calcium (Ca) is added to control the shape of inclusions in a manner of spheroidizing sulfur (S) inclusions. This enhances toughness of quenchable steel sheets.

Also, according to embodiments of the present invention, copper (Cu) is added to minimize hydrogen delayed fracture in steel or welding portions. Thus it is possible to manufacture quenchable steel sheets having enhanced resistance to hydrogen delayed fracture without additional processing incurring additional costs.

Therefore, quenchable steel sheets, which have superior press workability and satisfy a tensile strength of 1400 MPa or more and an elongation of 8% or more after pressing can be manufactured at comparatively low cost.

Such quenchable steel sheets can be variously applied to automobile parts at lower costs, in particular, can be reliably employed in automobile parts that are sensitive to hydrogen embrittlement.

DETAILED DESCRIPTION OF EMBODIMENTS

Figure 1:
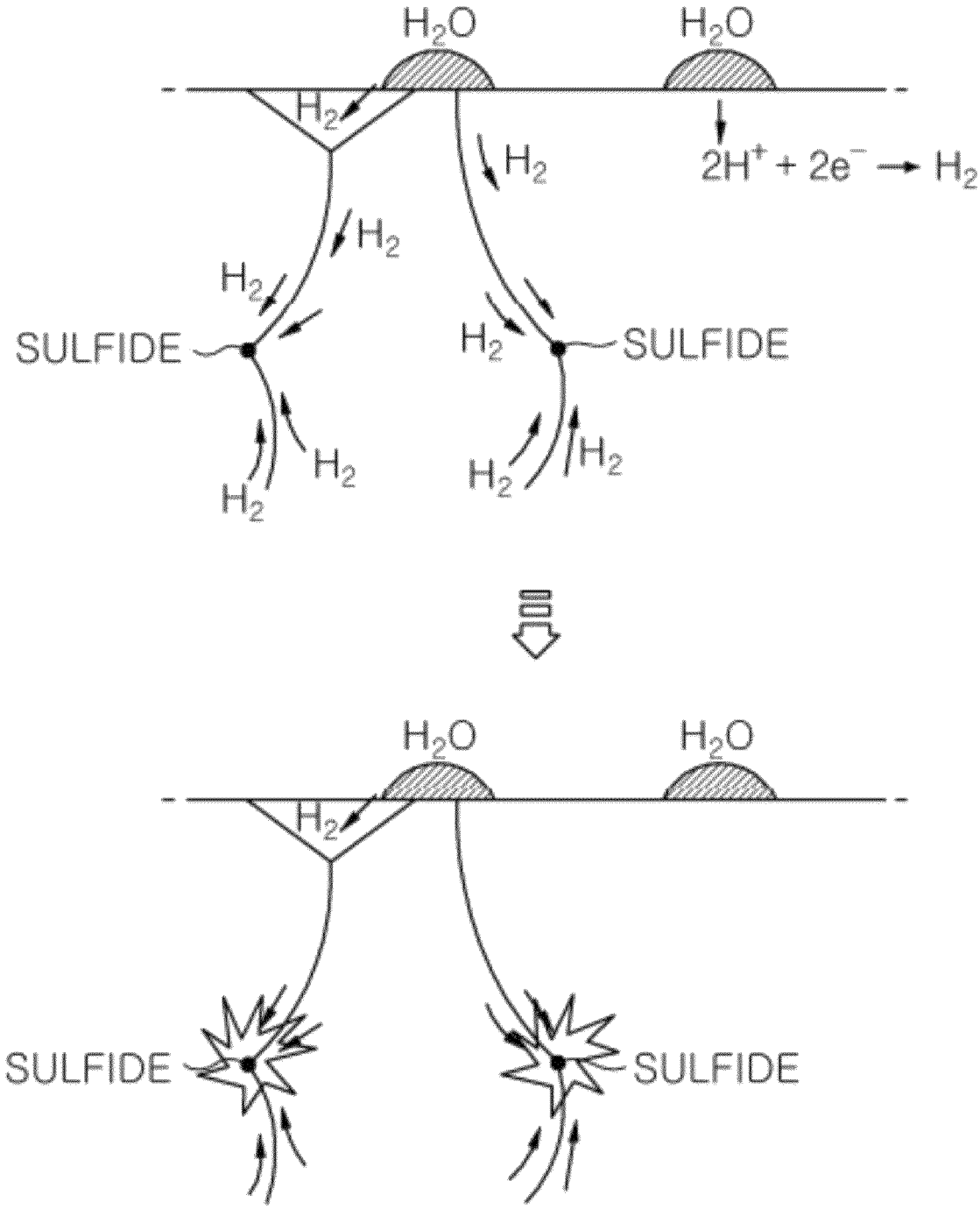
FIG. 1 schematically shows a hydrogen delayed fracture caused by moisture attached to the surface of a steel sheet which does not contain Cu.

Hereinafter, a detailed description will be given of a quenchable steel sheet having high hot press workability and a method of manufacturing the same according to embodiments of the present invention.

According to embodiments of the present invention, a quenchable steel sheet has an alloy composition comprising iron (Fe), carbon (C) in an amount of 0.15 to 0.30 wt %, silicon (Si) in an amount of 0.05 to 0.5 wt %, manganese (Mn) in an amount of 1.0 to 2.0 wt %, boron (B) in an amount of 0.0005 to 0.0040 wt %, sulfur (S) in an amount of 0.003 wt % or less, phosphorus (P) in an amount of 0.012 wt % or less, one or both selected from among calcium (Ca) in an amount of 0.0010 to 0.0040 wt % and copper (Cu) in an amount of 0.05 to 1.0 wt %, two or more selected from among cobalt (Co), zirconium (Zr) and antimony (Sb), and other inevitable impurities.

According embodiments of to the present invention, a manufacturing method includes heating a plated steel sheet having the above alloy composition to 700° C. or higher, placing the plated steel sheet into a die, and performing pressing at 600~900° C. and cooling in the die. The plated steel sheet is an Al—Si plated steel sheet.

Specifically, titanium (Ti), niobium (Nb), molybdenum (Mo), and chromium (Cr) are not added as they cause cracks to be formed on the steel sheet during the hot pressing. Instead, at least two selected from among Co, Sb and Zr are added to manufacture the quenchable steel sheet having hot ductility.

Titanium (Ti), niobium (Nb), molybdenum (Mo), and chromium (Cr) inhibit the production of a second phase such as perlite or bainite and also delay transformation to obtain martensite texture, but they may bind with C and N of steel to form a deposit, thereby undesirably decreasing hot ductility of the steel sheet.

Cobalt (Co) in an amount of 0.0005 to 0.5 wt %, zirconium (Zr) in an amount of 0.0005 to 0.1 wt % and antimony (Sb) in an amount of 0.0005 to 0.5 wt % may be added. In the selected two elements, Co and Sb are present in total amount to satisfy 0.0005 wt %≦(Co+Sb)≦0.5 wt %.

This is to increase stability of the strength of the steel sheet after hot pressing. If Co and Sb are present in a total amount less than 0.0005 wt %, there is no stability of the strength. In contrast, if a total amount of Co and Sb exceeds 0.5 wt %, it is difficult to control a steel making process, and the resulting steel sheet may deteriorate.

Zr and Co have a higher affinity for N, S, C and H than that of Ti, and are thus adapted to fix such elements. Zr may react with N like Ti to form ZrN, thereby preventing the formation of B into BN. When B is formed into BN, it is intergranularly precipitated and quenching properties may decrease.

Zr and Co may suppress intergranular corrosion while showing a good surface appearance; thus corrosion resistance increases.

Specifically, Zr and Co may be dispersed in the plating layer after plating the steel sheet, and form numerous nuclei. Such nuclei may cause intergranular interference in the course of coagulating the plating material; thus the growth of crystal grains is controlled. When the growth of crystal grains is controlled in this way, a good surface appearance may be obtained and intergranular corrosion may be suppressed; thus corrosion resistance is enhanced.

In particular, numerous nuclei dispersed in the plating layer are able to form a multilayered alloy plating that functions to inhibit and block the permeation of various elements of the external environment, for example, hydrogen.

The multilayered alloy plating may prevent the reaction between aluminum (Al) and iron (Fe); thus the growth of the alloy layer is inhibited, and a plating layer having high workability is formed. Even when the plating layer is formed to have a thickness of 10 μm to 30 μm, scales are not produced, and cracks and pores on the plating layer after hot pressing can be minimized.

When cracks and pores formed on the plating layer are minimized, corrosion resistance of the quenchable steel sheet may be increased, and the desired shape of parts may be freely formed. For reference, when an alloy layer of Al and Fe is formed upon plating, the plating layer may become brittle.

Furthermore, Co may inhibit Si or Mn forming an oxide on the surface of the steel sheet; thus plating wettability increases. Before hot pressing, the steel sheet is plated with Al—Si in order to prevent the generation of oxide scales at high temperatures. If an oxide of Si or Mn is formed on the surface of the steel sheet, the portion where the oxide is formed cannot be plated.

Also, the amounts of impurities, that is, the elements that decrease hot workability, such as P and S, are controlled to be present in a very small amount to improve hot workability.

In embodiments of the present invention, the amount and ratio of Co, Zr, Sb, P and S are controlled to improve hot press workability; thus hot pressing at a temperature of 600~900° C. can be performed without causing cracks.

The final microstructure according to embodiments of the present invention is martensite such that the final product has a tensile strength of 1400 MPa or more and an elongation of 20% or more even at a high temperature of 600~900° C.

Below, the alloy elements according to embodiments of the present invention are specified in terms of function and amount.

C: 0.15~0.30 wt %

C is an element essential to the high strength steel sheet. However, in order to increase the hardness of the quenchable steel sheet, the amount of C should be appropriately adjusted. If the amount of C is present in amount less than 0.15 wt %, the hardenability of the steel may decrease; thus after heat treatment it is difficult to obtain sufficient martensite structure which would ensure high tensile strength.

In contrast, if the amount of C exceeds 0.30 wt %, such hardenability may increase to ensure sufficient tensile strength. However, the strength of the steel before heat treatment may increase undesirably and it would be difficult to form a product.

Si: 0.05~0.5 wt %

Si is added as a deoxidizer for removing oxygen from steel in the steel making process. Also Si functions to enhance quenching properties. However, if too much amount of Si is added, an oxide may form on the surface of the steel sheet, and undesirably degrade plating properties. And, the viscosity of molten metal may increase, and thus, in a trimming step of the part manufacturing process, undesirable problems on the cut surface of the steel sheet can be caused. So, the upper limit of Si is set to 0.5 wt %. If the amount of Si is less than 0.05 wt %, desired effects cannot be obtained.

Mn: 1.0~2.0 wt %

Mn inhibits the production of perlite structure and promotes the formation of austenite and concentration of carbon in steel, and thus contributes to form residual austenite, and also functions to increase the quenching properties of the steel sheet and reliably ensure the strength of the steel sheet after quenching. Mn is added in an amount of 1.0 wt % or more so as to ensure a tensile strength of 1400 MPa or more. However, if the amount thereof exceeds 2.0 wt %, corrosion resistance and weldability may decrease. So, this element is added in an amount not exceeding 2.0 wt %.

B: 0.0005~0.0040 wt %

B is added to delay the transformation of austenite into ferrite so as to increase the quenching properties of the steel sheet. Thus after quenching a product may have high tensile strength. B should be added in an amount of 0.0005 wt % or more in order to increase the quenching properties of the steel sheet. However, if the amount thereof exceeds 0.0040 wt %, it is difficult to control a steel making process, and undesirable quality variations in the material after heat treatment are caused. So, this element is added in an amount not exceeding 0.0040 wt %.

Ca: 0.0010~0.0040 wt %

Ca may be added to enhance toughness of the steel sheet. Ca may spheroidize an S inclusion (MnS) to increase toughness. Even when the amount of S is controlled to be very small, if the S inclusion is present in a linear shape, impact resistance and toughness may decrease.

Ca is added after desulfurization in the steel making process.

If the amount of Ca is less than 0.0010 wt %, the effect thereof becomes insignificant. In contrast, if the amount thereof exceeds 0.0040 wt %, the effect cannot be maximized and it is difficult to control the steel making process.

In particular, in order to maximize the toughness of the steel sheet after hot pressing, the weight ratio of Ca/S should fall in the range of 0.5 to 3.0. If the weight ratio of Ca/S falls in the range of 0.5 to 3.0, the spheroidization effect of the S inclusion (MnS) may increase.

If the weight ratio of Ca/S is less than 0.5, the effect of maximizing toughness may become insignificant. In contrast, if the weight ratio thereof exceeds 3.0, such an effect cannot be maximized and it is difficult to control the steel making process.

Cu: 0.05~1.0 wt %

Cu may be added to prevent cathodic reaction of sulfide and intergranular hydrogen delayed fracture in steel or welding portions.

Cu may increase the quenching properties of the steel sheet and the stability of strength after quenching, and also may inhibit the cathodic reaction of sulfide and intergranular hydrogen permeation in steel or welding portions.

As shown in FIG. 1, when the steel sheet is exposed to moisture environments, moisture causes a reduction reaction, $2H^{+}+2e^{-}\text{-----}\rightarrow H_2$, by movement of electrons emitted from Fe which is a base metal. As such, $H_2$ produced by the reduction reaction may intergranularly diffuse into the base metal at a fast rate even at low temperatures; thus intergranular bondability is weakened.

When $H_2$ meets with sulfide in steel, intergranular bondability may be further weakened and cracks may be generated. Accordingly, sudden fracture may take place after a lapse of a predetermined period of time.

Figure 2:
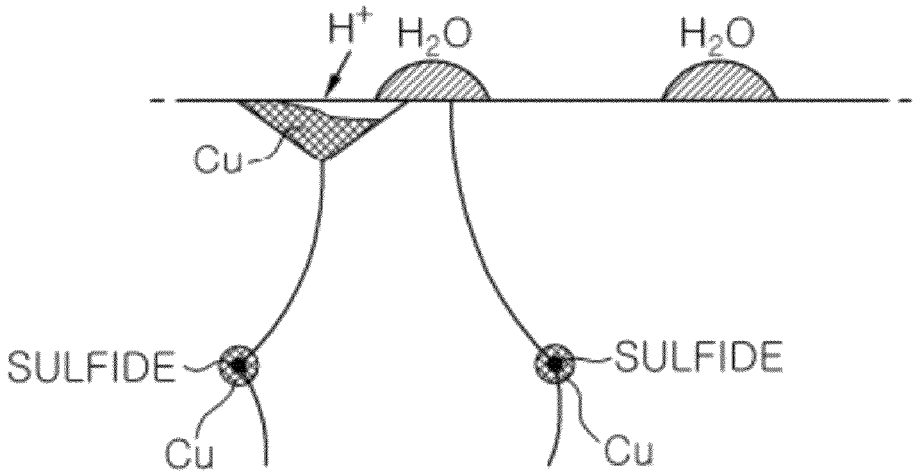
FIG. 2 schematically shows the principle of how Cu increases resistance to hydrogen delayed fracture.

As shown in FIG. 2, when Cu is added, Cu is positioned at the intergranules, and thus may inhibit internal permeation of $H_2$ and may surround the outer surface of sulfide to thus prevent the contact between $H_2$ and sulfide. Thus the cathodic reaction of sulfide by $H_2$ present in steel may be inhibited.

If the amount of Cu is less than 0.05 wt %, it is difficult to reduce hydrogen delayed fracture. In contrast, if the amount thereof exceeds 1.0 wt %, intergranular permeation of Cu may occur upon re-heating of a slab; thus cracks may be generated upon hot pressing.

Thus the amount of Cu is set to the range of 0.05~1.0 wt %.

S: 0.003 wt % or less

S is contained in an amount of about 0.015 wt % in molten steel after a typical desulfurization process. However, S may decrease hot workability of steel at high temperatures just as P does, and thus the amount thereof should be controlled to be minimized in order to enhance hot workability. Alongside the recent development of steel making techniques, the amount of S may be controlled to 0.003 wt % or less.

In particular, as the amount of S becomes low, impact absorption energy is increased after heat treatment. When the amount of S is controlled to 0.003 wt % or less compared to steel containing 0.010 wt % of S, impact absorption energy may be at least doubled.

The experimental results show that the steel sheet has impact absorption energy of 35 J when the amount of S is 0.010 wt %, but the impact absorption energy is doubled to 70 J when the amount of S is controlled to 0.003 wt %.

P: 0.012 wt % or less

P is contained in an amount of about 0.020 wt % in molten steel after a typical dephosphorization process. However, P may decrease hot workability of steel at high temperatures, and the amount thereof should be controlled to be very small in order to increase hot workability. Alongside the recent development of steel making techniques, P may be controlled to 0.012 wt % or less, which is set to the maximum value.

Zr: 0.0005~0.1 wt %

Zr may be added to remove N. N inevitably exists in the steel during the steel making process. N present in steel may bind with B and thus may precipitate as a BN compound, which may deteriorate quenching properties. In order to maximally prohibit the existence of N in steel, Zr is added to form a compound with N at high temperatures. When Zr is added in an amount of 0.0005 wt % or more, the desired effects can be expected. If the amount of Zr exceeds 0.1 wt %, there is no industrial value.

Co, Sb: 0.0005~0.5 wt %

These elements may increase the quenching properties of a steel sheet and stabilize the strength of the steel sheet after hot pressing. Thus these elements are added to ensure oxidation resistance at high temperatures and increase elongation.

When the total amount of Co and Sb is 0.0005 wt % or more, desired effects may be obtained. If the total amount thereof exceeds 0.5 wt %, it is difficult to control a steel making process and the steel sheet may deteriorate. Even when either of Co and Sb is added, it may be added in the above range for the same reasons.

The steel sheet according to embodiments of the present invention includes the above components, iron (Fe) and the elements that are inevitably present. Inevitable impurities such as N or 0 may be contained in trace amounts depending on conditions such as feeds, materials and manufacturing equipment.

The steel slab having the above composition is manufactured by using a steel casting process including providing molten steel and then forming an ingot or performing a continuous casting process. A hot-rolled or cold-rolled steel sheet is plated and then hot pressed; thus a quenchable steel sheet as below produced.

[Method of Manufacturing Quenchable Steel Sheet]

The steel slab according to embodiments of the present invention is manufactured by performing a steel making process including providing molten steel, and then forming an ingot or being subjected to a continuous casting process. In order to dissolve the components segregated when casting, the slab is re-heated in a furnace at 1100° C. or higher, and hot-rolled at a temperature of Ar3~Ar3+50; thus a single-phase hot-rolled coil is produced. Winding is carried out at a coiling temperature (CT) of 400~700° C. in order to facilitate cold-rolling. The surface of the steel sheet is pickled to remove an oxide.

Subsequently, cold-rolling is carried out. This cold-rolling is performed at a is reduction ratio of about 50 wt %, and the cold-rolled steel sheet may be used in a without plating or may be plated in order to prevent oxidation.

Al—Si plating is performed to inhibit oxide scales from being formed during hot pressing. The hot-rolled steel sheet may be used in a state of not having been plated or may be plated to prevent oxidation and be subjected to Al—Si plating.

Subsequently, hot pressing is performed to produce a final product having the desired shape. The hot pressing includes heating to 700° C. or higher which is a temperature of Ar3 or more, and then pressing at 600~900° C. to manufacture the final product. Cooling is performed at the same time as pressing is being conducted.

As such, even when the steel sheet is heated to have a temperature of 600~900° C. which is lower than a typical heating temperature, an elongation of 20% or more may be ensured at this temperature by controlling the amount and ratio conditions of Co, Zr, Sb, P, and S.

The component ratio of the above alloy elements is controlled so that hot pressing is performed in the range of 600~900° C. In the case of a plated steel sheet, stripping of the plating at the high temperature may be prevented. In the case of a non-plated steel sheet, the production of oxide scales on the surface of the steel sheet at the high temperature may be prevented. If the hot pressing process is carried out at a temperature lower than 600° C., it is difficult to ensure the desired press workability.

Below, examples of quenchable steel sheets having high hot press workability and the method of manufacturing the same are discussed.

EXAMPLES

A steel slab having each of alloy compositions shown in Table 1 was heated to 1100° C. or higher for 2 hours, finish-rolled at about 900° C., wound at 400~700° C. for 1 hour, and furnace-cooled to room temperature and cold-rolled to be a cold-rolled steel sheet. These cold rolled steel sheet was heated to 700° C. or higher, hot pressed at 600~900° C. and cooled in a die.

The alloy compositions of the comparative example and inventive Examples are shown in Table 1, and the mechanical properties of steel sheet products manufactured using the alloy compositions of Table 1 at high temperatures and room temperature (RT) are shown in Table 2 below.

TABLE 2

| | Temp. | | | | | | | |
|---|---|---|---|---|---|---|---|---|
| | 600° C. | | 700° C. | | 900° C. | | RT Part | |
| | Tensile Strength | EL | Tensile Strength | EL | Tensile Strength | EL | Tensile Strength | EL |
| C. Ex. 1 | 228 | 16 | 132 | 17 | 104 | 22 | 1520 | 6 |
| Inv. Ex. 1 | 223 | 22 | 153 | 24 | 106 | 28 | 1550 | 10 |
| Inv. Ex. 2 | 232 | 20 | 169 | 23 | 118 | 26 | 1507 | 9 |
| Inv. Ex. 3 | 201 | 20 | 128 | 21 | 98 | 23 | 1560 | 8 |
| Inv. Ex. 4 | 203 | 20 | 129 | 21 | 99 | 24 | 1560 | 10 |
| Inv. Ex. 5 | 202 | 20 | 127 | 21 | 98 | 24 | 1559 | 10 |

[MPa: tensile strength, EL (wt %): elongation]

As is apparent from Tables 1 and 2, when two or more selected from among Co, Sb and Zr are added instead of Al, Ti and Cr, it can be guaranteed that the elongation of the steel be 20% or more at a high temperature of 600~900° C.

In the case of parts resulting from hot pressing the steel sheet having the elongation of 20% or more at high temperatures, it can be seen that a tensile strength of 1400 MPa and an elongation of 8% or more at a room temperature are obtained after cooling in the die.

When Ca is added in the range of weight ratio of Ca/S of 0.5~3.0, the elongation is further improved (see Inventive Examples 3 to 5).

The hot pressing process as above may be applied to an Al—Si plated steel sheet.

The quenchable steel sheet manufactured as above enables hot pressing at 600~900° C., and thus a plating layer is protected, the generation of oxide scales is prevented, and high tensile strength is ensured.

Figure 3:
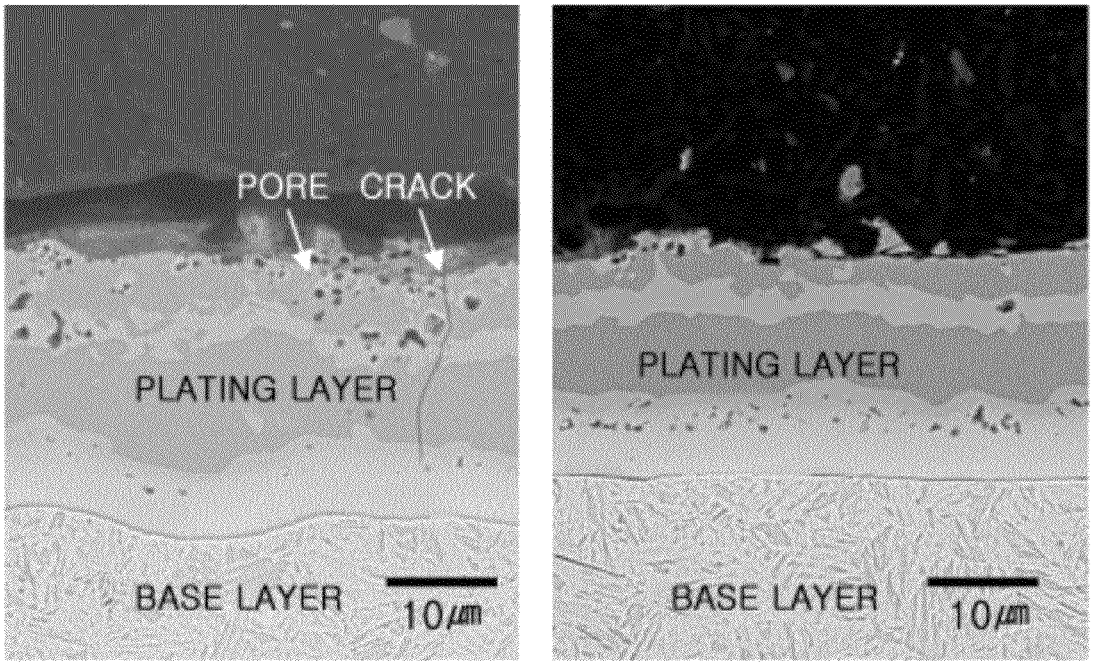
FIG. 3 shows scanning electron microscope (SEM) images of plating layers after hot pressing in (a) Comparative Example 1 and (b) Inventive Example 1.
Figure 4:
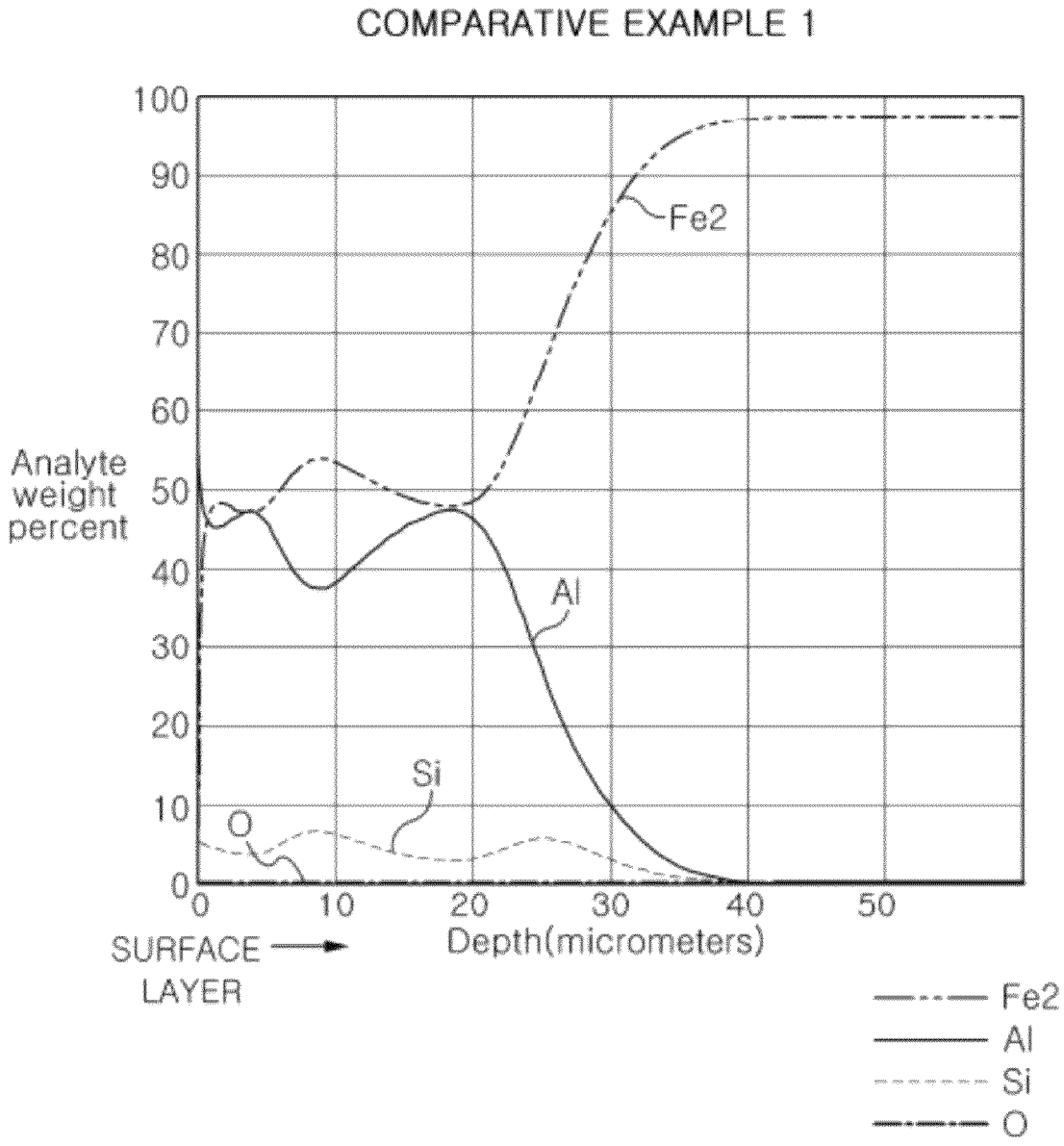
FIG. 4 shows the glow discharge spectrometry (GDS) profile of an element distribution in a depth direction from a surface of the steel sheet in (a) Comparative Example 1 after hot pressing.
Figure 5:
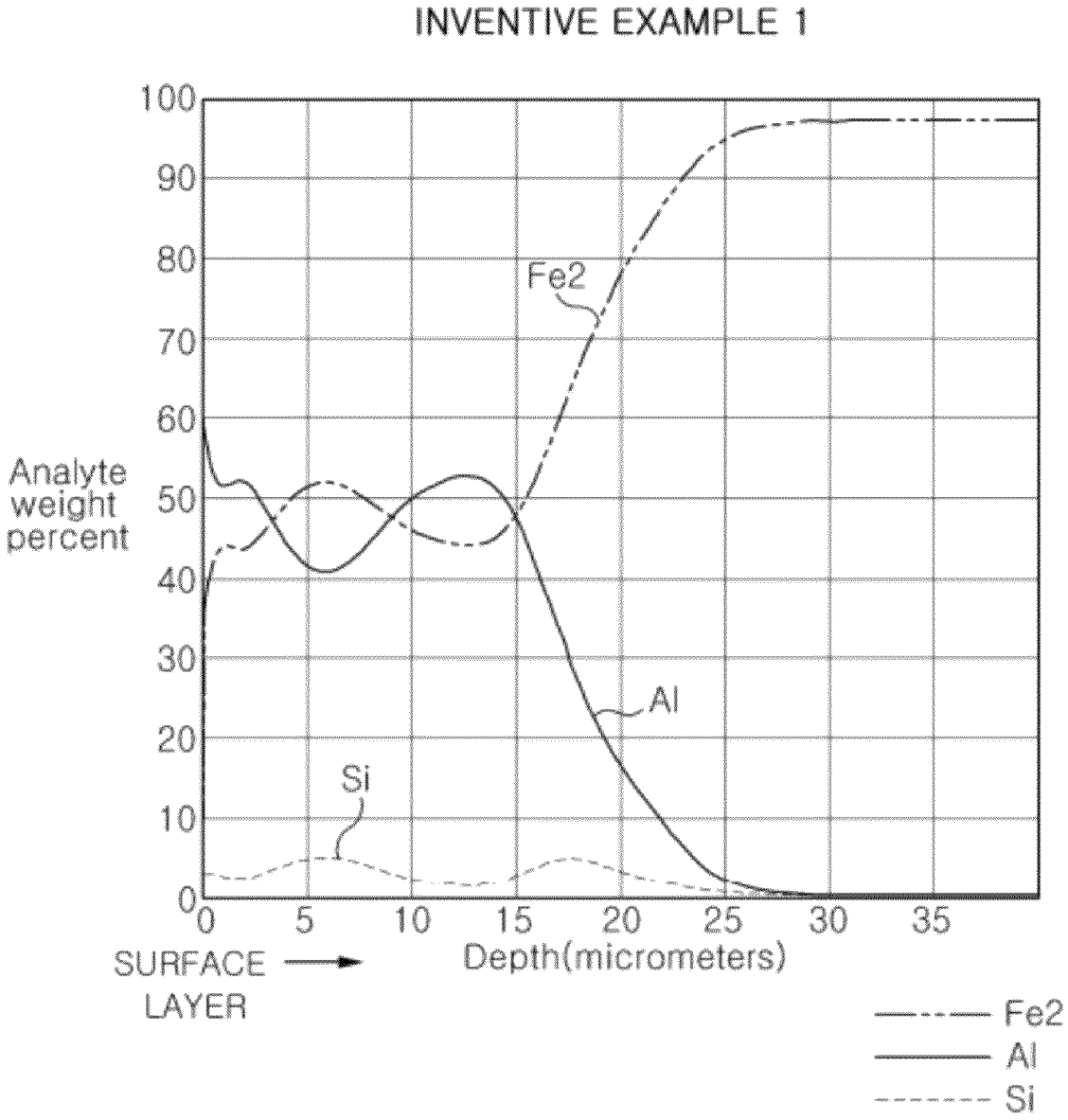
FIG. 5 shows the GDS profile of an element distribution in a depth direction from a surface of the steel sheet in (b) Inventive Example 1 after hot pressing.

FIG. 3 shows SEM images of the plating layer after hot pressing in (a) Comparative Example 1 and (b) Inventive Example 1. FIG. 4 shows the GDS profile of element distribution in a depth direction from the surface layer of the steel sheet of (a) Comparative Example 1. FIG. 5 shows the GDS profile of element distribution in a depth direction from the surface layer of the steel sheet of (b) Inventive Example 1.

As shown in FIG. 3, in the case of (a) Comparative Example 1, there are cracks and pores generated on the plating layer, and in the case of (b) Inventive Example 1, neither cracks nor pores can be seen on the plating layer.

TABLE 1

(Final Alloy Composition of Steel Sheet wt %: remainder Fe)

| | C | Si | Mn | P | S | Cu | Ca | Al | Ti | Cr | Co | Zr | Sb | B | Note |
|---|---|---|---|---|---|---|---|---|---|---|---|---|---|---|---|
| C. Ex. 1 | 0.20 | 0.3 | 1.2 | 0.018 | 0.006 | — | — | 0.02 | 0.035 | 0.2 | — | — | — | 0.002 | Al Deoxidizer |
| Inv. Ex. 1 | 0.23 | 0.3 | 1.2 | 0.005 | 0.001 | 0.05 | — | — | — | — | 0.10 | 0.03 | 0.02 | 0.002 | Si Deoxidizer |
| Inv. Ex. 2 | 0.23 | 0.3 | 1.5 | 0.007 | 0.002 | 0.05 | — | — | — | — | 0.05 | — | 0.03 | 0.002 | Si Deoxidizer |
| Inv. Ex. 3 | 0.23 | 0.3 | 1.5 | 0.012 | 0.003 | 0.05 | — | — | — | — | 0.20 | 0.05 | — | 0.002 | Si Deoxidizer |
| Inv. Ex. 4 | 0.23 | 0.3 | 1.5 | 0.012 | 0.003 | 0.05 | 0.0030 | — | — | — | 0.20 | 0.05 | — | 0.002 | Si Deoxidizer |
| Inv. Ex. 5 | 0.23 | 0.3 | 1.5 | 0.012 | 0.003 | — | 0.0030 | — | — | — | 0.20 | 0.05 | — | 0.002 | Si Deoxidizer |

As shown in FIGS. 4 and 5, in the case of (a) Comparative Example 1, the amount of Fe is remarkably increased at a position of 40 μm downward from the surface of the plating layer, whereas in the case of (b) Inventive Example 1 the amount of Fe is considerably increased at a position of 25 μm downward from the surface of the plating layer. The drastic increase in the amount of Fe indicates that the plating layer comes to an end, and thereby the thickness of the plating layer may be estimated.

Even when the plating layer is formed as thin as 10~30 μm, scales do not form and the generation of cracks and pores on the plating layer is reduced; thus corrosion resistance increases.

Although the embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A steel sheet of a steel alloy composition comprising:
iron (Fe);
carbon (C) in an amount of 0.15 to 0.30 wt %;
silicon (Si) in an amount of 0.05 to 0.5 wt %;
manganese (Mn) in an amount of 1.0 to 2.0 wt %;
boron (B) in an amount of 0.0005 to 0.0040 wt %;
sulfur (S) in an amount of 0.003 wt % or less;
phosphorus (P) in an amount of 0.012 wt % or less;
one or both of calcium (Ca) and copper (Cu), calcium being in an amount of 0.0010 to 0.0040 wt %, copper being in an amount of 0.05 to 1.0 wt % of copper (Cu); and
two or more selected from the group consisting of cobalt (Co), zirconium (Zr) and antimony (Sb),
wherein the cobalt (Co) and the antimony (Sb) are present in amounts to satisfy 0.0005 wt %≦(Co+Sb)≦0.5 wt %,
wherein the steel alloy composition does not comprise any one of Titanium (Ti), Niobium (Nb), Molybdenum (Mo) and Chromium (Cr).

2. The steel sheet of claim 1, wherein the zirconium (Zr) is present in an amount of 0.0005 to 0.1 wt %.

3. The steel sheet of claim 1, wherein a weight ratio of Ca/S is between 0.5 and 3.0.

4. The steel sheet of claim 1, wherein the alloy composition comprises antimony (Sb) in an amount of 0.02 to 0.5 wt %.

5. A steel sheet comprising:
a first layer of a steel alloy composition which comprises iron (Fe) and at least one of cobalt (Co) and zirconium (Zr); and
a second layer comprising Al—Si and plated on the first layer,
wherein at least one of cobalt (Co) and Zirconium (Zr) is dispersed in the second layer,
wherein the steel alloy composition comprises:
carbon in an amount of 0.15 to 0.30 wt %;
silicon (Si) in an amount of 0.05 to 0.5 wt %;
manganese (Mn) in an amount of 1.0 to 2.0 wt %;
boron (B) in an amount of 0.0005 to 0.0040 wt %;
sulfur (S) in an amount of 0.003 wt % or less;
phosphorus (P) in an amount of 0.012 wt % or less; and
one or both of calcium (Ca) and copper (Cu), calcium being in an amount of 0.0010 to 0.0040 wt %, copper being in an amount of 0.05 to 1.0 wt % of copper (Cu),
wherein the steel alloy composition does not comprise any one of Titanium (Ti), Niobium (Nb), Molybdenum (Mo) and Chromium (Cr).

6. The steel sheet of claim 5, wherein the second layer comprises a plurality of nuclei of the at least one of cobalt (Co) and Zirconium (Zr).

7. The steel sheet of claim 5, wherein the second layer has a thickness between 10 μm and 30 μm.

8. The steel sheet of claim 5, wherein the steel alloy composition comprises antimony (Sb) in an amount of 0.02 to 0.5 wt %.

* * * * *